US006837737B2

(12) United States Patent
Baier et al.

(10) Patent No.: US 6,837,737 B2
(45) Date of Patent: Jan. 4, 2005

(54) BUS CONNECTOR

(75) Inventors: Terence D. Baier, La Crosse, WI (US); Brent J. H. Helgeson, La Crosse, WI (US)

(73) Assignee: American Standard International Inc., New York, NY (US)

( * ) Notice: Subject to any disclaimer, the term of this patent is extended or adjusted under 35 U.S.C. 154(b) by 0 days.

(21) Appl. No.: 10/272,387

(22) Filed: Oct. 10, 2002

(65) Prior Publication Data

US 2004/0072476 A1 Apr. 15, 2004

(51) Int. Cl.[7] ..... H01R 4/24
(52) U.S. Cl. ..... 439/402; 439/404
(58) Field of Search ..... 439/402, 404, 439/405, 417, 677

(56) References Cited

U.S. PATENT DOCUMENTS

| | | | | |
|---|---|---|---|---|
| 3,736,505 A | | 5/1973 | Sankey | |
| 3,985,416 A | * | 10/1976 | Dola et al. | 439/403 |
| 4,030,799 A | | 6/1977 | Venaleck | |
| 4,295,704 A | | 10/1981 | Narozny et al. | |
| 4,668,039 A | * | 5/1987 | Marzili | 439/404 |
| 4,778,405 A | | 10/1988 | Sterken | |
| 5,174,782 A | | 12/1992 | Bogiel et al. | |
| 5,199,899 A | * | 4/1993 | Ittah | 439/403 |
| 5,338,220 A | * | 8/1994 | Soes et al. | 439/403 |
| 5,371,323 A | | 12/1994 | Schneider et al. | |
| 5,376,018 A | * | 12/1994 | Davis et al. | 439/405 |
| 5,498,172 A | | 3/1996 | Noda | |
| 5,606,150 A | | 2/1997 | Radliff et al. | |
| 5,651,691 A | | 7/1997 | Grumel | |
| 5,722,851 A | | 3/1998 | Onizuka et al. | |
| 5,759,065 A | | 6/1998 | Hatagishi et al. | |
| 6,193,541 B1 | * | 2/2001 | Lee | 439/405 |
| 6,398,581 B1 | | 6/2002 | Baier et al. | |

FOREIGN PATENT DOCUMENTS

| | | |
|---|---|---|
| EP | 0 336 695 A2 | 10/1989 |
| EP | 0 571 156 A2 | 11/1993 |
| WO | WO 97/05682 | 2/1997 |

* cited by examiner

*Primary Examiner*—Thanh-Tam Le
(74) *Attorney, Agent, or Firm*—William J. Beres; William O'Driscoll

(57) ABSTRACT

A system for electrically connecting electrical components. The system comprises a first ribbon cable; a connector cap including a track area adapted to operably engage the ribbon cable, and a connector base having a first ribbon cable receptacle area adapted to electrically engage the first ribbon cable. The connector cap includes a first pair of posts spaced a first distance apart and a second pair of posts spaced a second distance apart, the second distance differing from the first distance. The connector base includes a second receptacle area adapted to electrically engage a second ribbon cable, electrical interconnection wiring electrically interconnecting the first and second receptacles, and a receptacle operably positioned and sized to receive the first pair of posts and sized to interfere with the second pair of posts.

25 Claims, 3 Drawing Sheets

FIG. 1
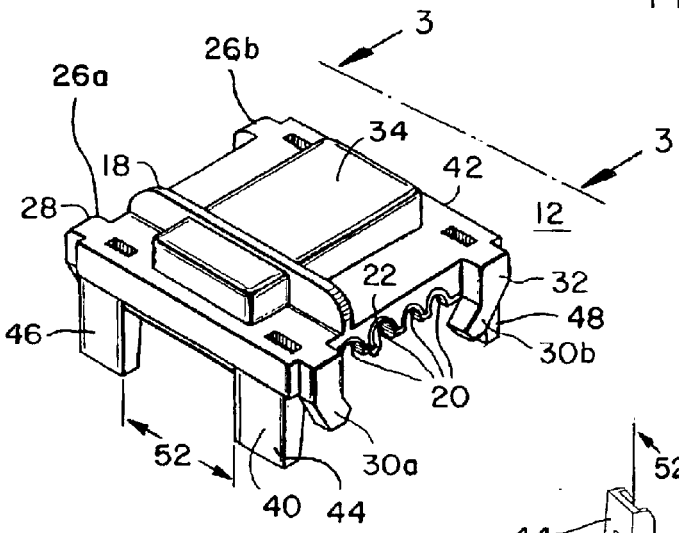
FIG. 2
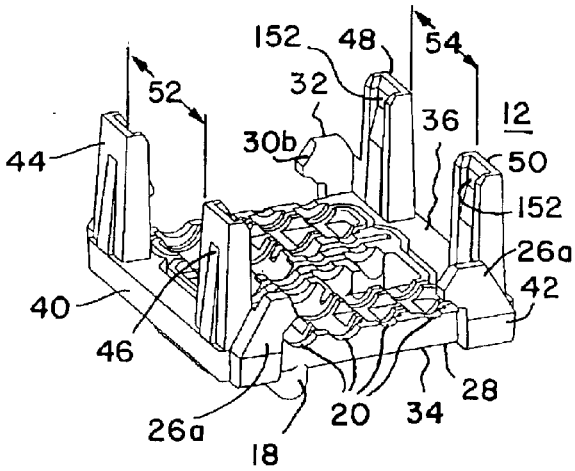
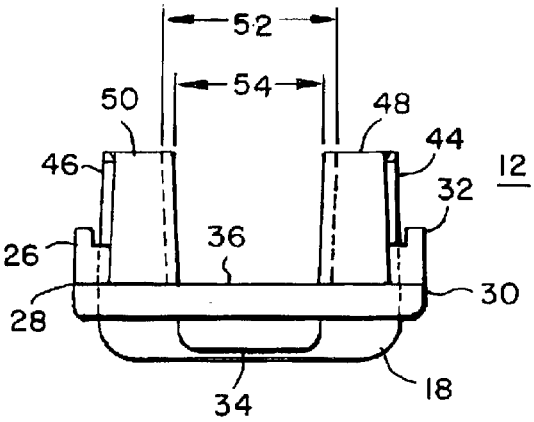
FIG. 3
FIG. 7
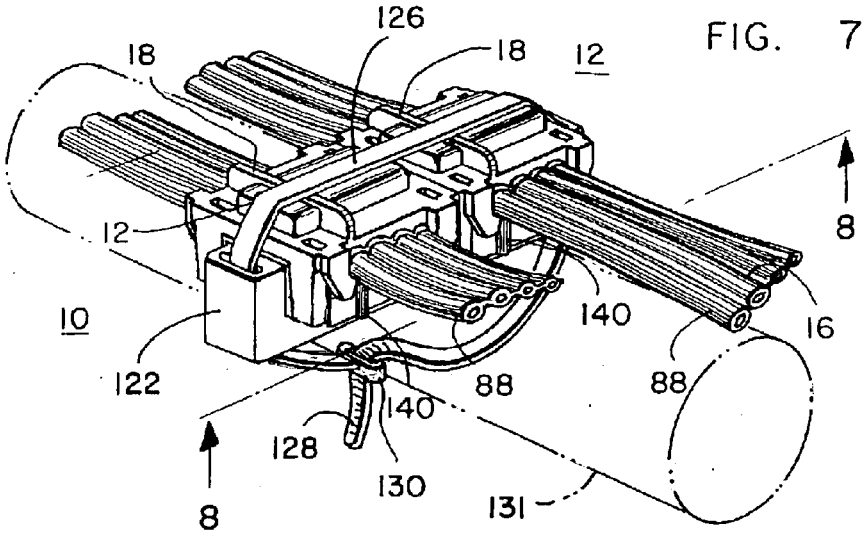

BUS CONNECTOR

BACKGROUND OF THE INVENTION

The present invention is directed to improvements in a bus connector which includes a pair of bus connector caps secured to a bus connector base so that each cap secures a bus cable in operable connection with the connector base. For purposes of this application, the words "bus", "cable" and "bus cable" are intended to encompass both a physical communications medium and the transmissions over that medium, unless it is otherwise apparent from the context.

Bus connectors like those shown in commonly assigned U.S. Pat. No. 6,398,581 to Baier et al. facilitate the interconnection of buses that have been found to have certain installation problems. These problems include the fact that even though the cap and base have a guide post arrangement to ensure the correct orientation of the cap relative to the base, incorrect installations still occur. Additionally, there is a need to sometimes secure the assembled connector to a fixture such as a post or bar to a set of cables or the like.

It is desirable that the base connectors and caps can be only assembled in one orientation so that the corresponding lines of a pair of buses being connected by the connector will be connected, as opposed to the connection of opposed lines if one of the buses were somehow reversed. It is also desirable to secure the assembled connector to a fixture.

SUMMARY OF THE INVENTION

It is an object, feature and advantage of the present invention to solve the problem with prior electrical connectors.

It is an object, feature and advantage of the present invention to provide a bus connector having a cap which can be placed in non-slideable relation with a communications bus.

It is a further object, feature and advantage of the present invention that the communications bus be a flat ribbon cable.

It is an object, feature and advantage of the present invention to provide an alignment guide to assist an assembler in correctly interconnecting a pair of buses with a bus connector device.

It is an object, feature and advantage of the present invention to provide a connector cap or caps and a connector base which can only be assembled in one orientation.

It is an object, feature and advantage of the present invention to provide a bus connector which can be easily secured to a fixture.

The present invention provides a system for electrically connecting electrical components. The system comprises a first ribbon cable; a connector cap including a track area adapted to operably engage the ribbon cable and a connector base having a first ribbon cable receptacle area adapted to electrically engage the first ribbon cable. The cap includes a first pair of posts spaced a first distance apart and a second pair of posts spaced a second distance apart. The second distance differs from the first distance. The base includes a second receptacle area adapted to electrically engage a second ribbon cable, electrical interconnection wiring electrically interconnecting the first and second receptacles, and a receptacle operably positioned and sized to receive the first pair of posts and sized to interfere with the second pair of posts.

The present invention also provides a connector for operably connecting a first and a second communications bus. The connector comprises a connector base including first and second substantially identical cap engagement areas. Each cap engagement area including tracks adapted to receive the first or second communications bus and contacts for each track adapted to electrically engage a portion of said communications bus. Each contact in a cap engagement area is in electrical connection with a corresponding contact in the other cap engagement area to form electrically connected pairs of contact. The base includes first and second blockoffs proximal to respective first and second cap engagement areas. The connector also comprises a first bus connector cap including tracks sized to receive and retain the first or second communications bus and including a pair of posts sized to interferingly engage the blockoffs if the cap is assembled to the base in a particular orientation. The connector may also include a slot penetrating the base and shaped to receive a cable tie.

The present invention further provides an electrical connector for connecting first and second communications buses. Each bus includes at least first and second conduits. The connector comprises a non-conductive housing including a first receptacle portion and first contacts for receiving a first bus and a second receptacle portion and second contacts for receiving a second bus. The housing further includes electrical connections operably and electrically interconnecting the first contacts with the second contacts. The connector also comprises a first cover portion adapted for and operably engaging the first receptacle portion to form a first electrical connection between the first contacts and the first bus such that the first electrical connection is insulated from external electrical contacts; and second cover portion adapted for and operably engaging second receptacle portion to form a second electrical connection between the second contacts and the second bus such that the second electrical connection is insulated from external electrical contacts. The housing further includes at least one aperture sized to receive a fastener.

The present invention additionally provides a bus connector. The connector comprises a first cap having a first side and a second side not adjacent to the first side and a base adapted to receive at least the first cap in operable engagement. The cap includes a first pair of alignment arms proximal the first side projecting therefrom wherein the first pair of arms are spaced a first distance apart. The cap includes a second pair of arms proximal the second side and projecting therefrom in a direction corresponding to the direction that the first pair of arms project wherein the second pair of arms are spaced apart a second distance differing from the first distance. The base includes a first cap reception area having a first portion adapted to receive the first pair of arms but not to receive the second pair of arms and having a second portion adapted to receive the second pair of arms.

BRIEF DESCRIPTION OF THE DRAWING

FIG. 1 is a perspective top side view of a bus connector cap in accordance with the present invention.

FIG. 2 is a perspective, underside of the connector cap of FIG. 1.

FIG. 3 is an end view of the bus connector cap taken along lines 3—3 of FIG. 1.

FIG. 7 is a drawing of the assembled bus connector of the present invention in perspective with a pair of connector caps securing a pair of ribbon buses to a connector base.

DETAILED DESCRIPTION OF THE INVENTION

Figure 4:
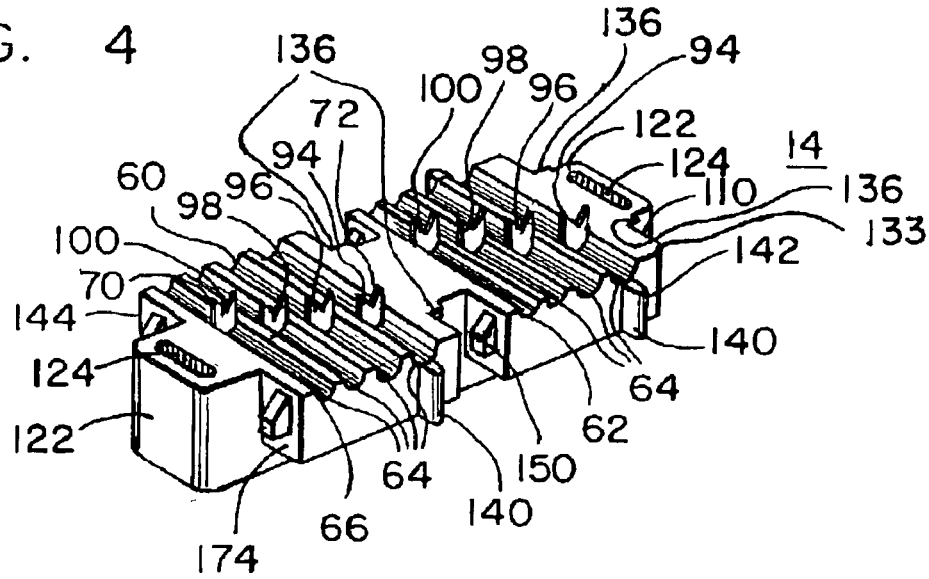
FIG. 4 is a perspective view of the connector base of the present invention taken from a first upper orientation.

The present invention is an improvement to commonly assigned U.S. Pat. No. 6,398,581 to Baier et al., which is hereby incorporated by reference.

Referring to all the figures of the drawing, the present invention is directed to a bus connector 10 which includes a pair of bus connector caps 12 and a connector base 14. The bus connector caps 12 are secured to bus connector base 14 to form the bus connector 10 such that each cap 12 secures a bus 16 in operable connection with the base 14 and the connector base 14 electrically connects a pair of busses 16.

Now referring specifically to FIGS. 1–3, each cap includes a bus alignment guide 18 which is preferably color coded to enable an assembler to correctly align the bus 16 with the bus connector cap 12 by aligning a particular color on the bus 16 with the bus alignment guide 18. The bus connector cap 12 preferably includes molded tracks 20 extending the length of the bus connector cap 12 parallel to the direction of the guide 18 and sized to receive and retain an appropriate bus 16. Preferably, the tracks include a sealant 22 overlaying the tracks 20 on the cap 12 in a shape preformed to the bus 16 so as to provide a relatively impermeable seal about the bus 16 when the bus connector 10 is fully assembled.

The bus connector cap 12 also includes a pair of retaining arms 26 on a first side 28, and a second pair of retaining arms 30 on a second opposed side 32. Preferably, the bus 16 has different sized wiring, and the retaining arms 26, 30 are sized so that the bus 16 can only be placed in the tracks 20 in the correct orientation. Specifically, the retaining arms 26*a*, 30*a* proximal the bus alignment guide 18 are sized to receive a larger line whereas the retaining arms 26*b*, 30*b* are sized to receive a smaller line and not to receive the larger line.

The guide 18 is on a top side 34 of the bus connector cap 12, while the tracks 20 are on a bottom side 36 of the bus connector cap 12. The bus connector cap 12 includes a guide side 40 nearest the guide 18 and an opposed offside side 42 farthest from the guide 18 where both the guide side 40 and the offside side 42 are parallel to the guide 18.

The bus connector cap 12 includes four alignment posts 44, 46, 48, 50 where the alignment posts 44, 46 form a first pair on the guide side 40 and where the alignment posts 48, 50 form a second pair on the offset side 42. On the guide side 40, the posts 44, 46 are spaced apart a first distance 52. On the offset side 42, the alignment posts 48, 50 are spaced apart a second distance 54. To help ensure that the bus connector cap 12 can only be aligned to and assembled with the connector base 14 in one orientation, the distance 52 is different from the distance 54. This ensures that either the first pair of alignment posts 44, 46 or the second pair of alignment posts 48, 50 will have an interference with a part of the connector base 14 if the bus connector cap 12 is incorrectly oriented. In the preferred embodiment the first distance 52 has the dimension 0.443 inches, and the second distance 54 has a smaller dimension 0.381 inches.

Figure 5:
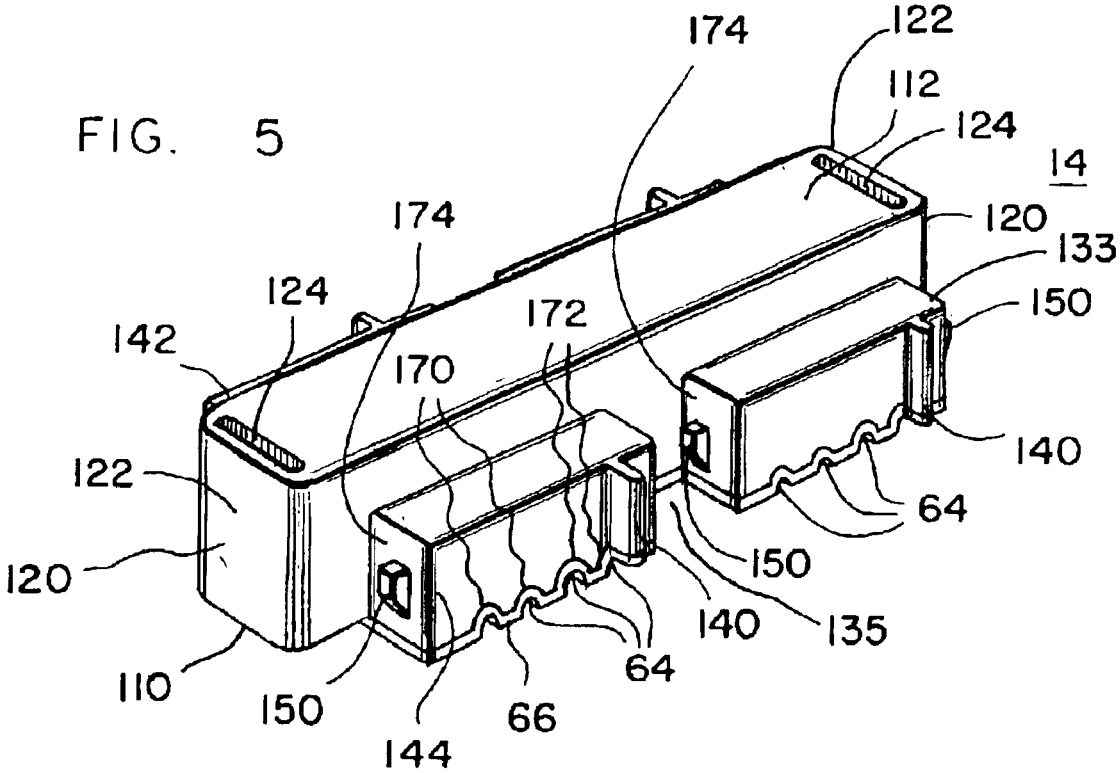
FIG. 5 is a perspective view of the connector base of FIG. 3 taken from a second lower orientation.
Figure 8:
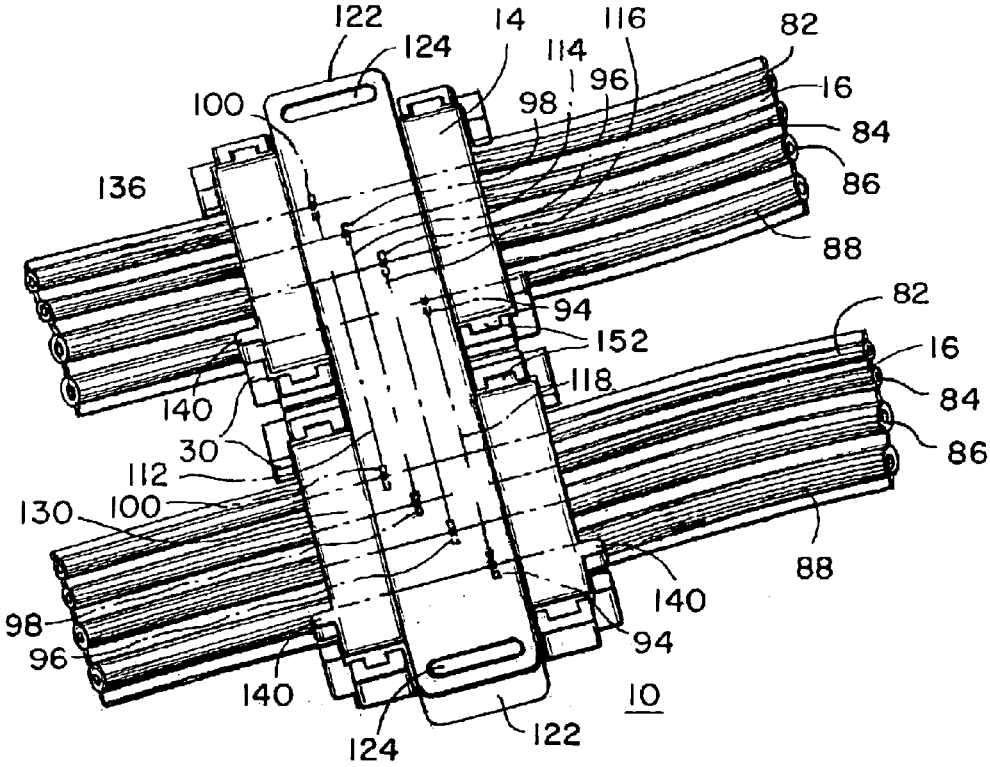
FIG. 8 shows the assembled connector of FIG. 7 along lines 8—8.

Referring now to FIGS. 4, 5 and 8, each base 14 preferably includes a first cap engagement area 60 and a second cap engagement area 62 where the first and second cap engagement areas 60, 62 are substantially identical and where the cap engagement areas 60, 62 are located on a top side 110 of the base 14. Each cap engagement area 60, 62 includes molded tracks 64 adapted to receive a bus connector 16 and are preferably overlain with a sealant 66 in a shape performed to the bus 16 so as to seal around the bus connector 16 in a weatherproof manner. Each track 64 includes a contact 70 having one or more edges 72 adapted for engaging a particular electrical connecting line 80 in the bus connector 16, cutting through the insulating cover and making electrical connection between the contact and the actual electrical conductive line 80. In the preferred embodiment, the bus connector 16 includes four electrical connector lines 82, 84, 86 and 88 held in flat relationship by a plastic ribbon 90 to form a plastic ribbon cable 92.

Also referencing FIG. 8, each cap engagement area 60, 62 includes a contact 94 adapted to engage the line 88, a contact 96 adapted to engage the line 86, a contact 98 adapted to engage the line 84, and a contact 100 adapted to engage the line 82. Within and insulated by the base 14 itself, the contact 100 of cap engagement area 60 is electrically connected by a conductor 112 to the contact 100 of cap engagement area 62. Similarly, contacts 98, 96 and 94 of cap engagement area 60 are respectively electrically connected within the base 14 to the contacts 98, 96 and 94 of the cap engagement area 62 by conductors 114, 116, 118.

The base 14 includes cap alignment guides 140 aligned with the track 64 holding the contacts 94 and the line 88. The line 88 is sized to engage the restraining arms 26*a* and 30*b* but to be too large to engage the restraining arms 26*h*, 30*b*. Both a first side 142 of the base 14 and a second side 144 of the base 14 preferably include the guides 140. The base 14 also includes projections 150 for engaging mating indentations 152 on the bus connector caps 12.

Preferably, each longitudinal end 120 of the connector base 14 includes a molded guide support 122 having a guide slot 124 completely penetrating the guide support 122, although a single guide slot 124 at one longitudinal end 120 will suffice for purposes of this invention. The guide slot 124 is sized and formed to accept a conventional cable tie 126. This allows the lead end 128 of the cable tie 126 to be fed through at least one and preferably both guide slots 124 and conventionally engaged with the female end 130 of the cable tie 126 about a fixture 131 such as a cable, post, pipe or anything else to which a cable tie could be attached to restrain the movement of the assembled bus connector 10. Exemplary cable ties are sold by such companies as General Wiring Components Ltd., Grainger, and Panduit under various trademarks and model identifiers.

In the preferred embodiment, the connector base 14 includes molded blockoffs 136 dimensional and positioned proximal to a side 133 or channel 135 nearest to and parallel to the guide 140 so as to interfere with the alignment posts 48, 50 but not to interfere with the alignment posts 44,46 thereby ensuring that but connector caps 12 can only be assembled to the bus connector base 14 in one orientation. Of course, the molded blockoffs could be repositioned to an opposing side of the cap retention areas 60, 62 to interfere with the posts 44, 46 and not to interfere with the posts 48, 50.

To assemble the bus connector 10, a bus connector cap 12 is aligned with and placed on a bus 16 such that the electrical lines 80 are in the tracks 20. In the preferred embodiment, the electrical lines 82, 84 are of a different gauge than the lines 86, 88 and there are two sizes of tracks 170, 172 to help ensure that the bus 16 and the bus connector cap 12 are aligned in a single alignment. Additionally, the bus alignment guide 18 is aligned with the electrical line 88 through the use of color coding the line 88 and the guide 18. The retainers 26, 30 and the sealant 22 engage the flat ribbon cable 92 in an interfering manner and in a single orientation so as to prevent the sliding of the bus connector cap 12 with relation to the cable 16 in a frictional manner.

Figure 6:
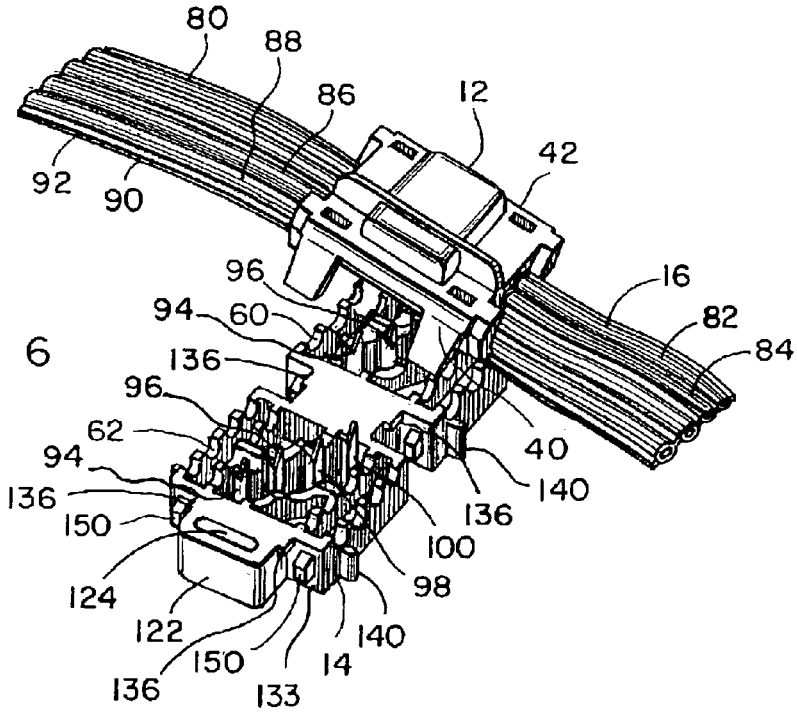
FIG. 6 shows the cap and bus of the present invention in pre-assembly relation with the connector base.

As is shown in FIG. 6, the bus 16 and the bus connector cap 12 are then moved over the desired cap engagement area 60, 62, the first pair of posts 44, 46 is aligned with the blockoffs 136 on the side 133 or the channel 135, the second pair of posts 48,50 aligned with the opposing 174 sides, the bus alignment guide 18 is aligned with a cap alignment guide 140, and the bus retainer cap 12 is pressed into engagement with a cap engagement area 62 such that the projections 150 retain and operably engage the receptacles 152. The same procedure is repeated with a second receptacle connector cap 12 and a second bus 16 for the cap engagement area 60 to complete the bus connector 10. This completed bus connector 10 is shown in FIGS. 7 and 8. Correct assembly is assured by aligning the guides 18 and the guides 140 of the respective bus connector cap 12, the bus 16, and the bus connector base 14 and by aligning the pairs of posts 44, 46 and 48, 50 with the respective sides 174, ends 133 or channels 135, and blockoffs 136.

In the preferred embodiment the electrical line 88 provides power, the line 86 is also part of the power circuit acting as a ground or common line, while the lines 84 and 82 provide a conventional two line RS-485 communications protocol.

What has been shown is a bus connector for connecting two ribbon cable buses operably and electrically using a pair of connector caps and a connector base. It will be apparent to a person of ordinary skill in the art that many changes and modifications could be made. The nature of the bus itself could be varied to a variety of conventional media including increasing or decreasing the number of electrical connecting lines in the ribbon bus, changing from a ribbon bus to other forms of electrical connecting buses or other conventional modifications. Additionally, the alignment posts can be modified to other shapes and arrangements, and the guide slot can be modified to receive other conventional fasteners such as radiator clamps, bolts, screws, rivets or the like. Moreover, either or both the alignment post pairs could be moved to another side of the cap so that the pairs of posts were on adjacent sides, or so that the pairs of posts are on opposing sides but rotated 90°.

What is desired to be secured for Letter Patent of the United States is set forth in the following claims.

What is claimed is:

1. A system for electrically connecting electrical components, the system comprising:

a first ribbon cable;

a connector cap including a track area adapted to operably engage the first ribbon cable, a first pair of posts spaced a first distance apart and a second pair of posts spaced a second distance apart, the second distance differing from the first distance; and a connector base having a first ribbon cable receptacle area adapted to electrically engage the first ribbon cable, a second receptacle area adapted to electrically engage a second ribbon cable, means electrically interconnecting the first and second receptacles, and a receptacle operably positioned and sized to receive the first pair of posts and sized to interfere with the second pair of posts.

2. The system of claim 1, wherein the receptacle includes a blockoff positioned to interfere with the second pair of posts such that the connector cap can only be assembled to the connector base in one orientation.

3. The system of claim 2, wherein the connector base includes means for affixing the base to a fixture.

4. The system of claim 3, wherein the affixing means includes a base end having a guide slot sized to receive a cable tie.

5. The system of claim 4, wherein the first and second ribbon cables include electrical connecting wires of different gauges and wherein the connector base and the connector cap respectively include cap and base tracks having varying size portions operatively adapted to receive the varying gauge electrical lines of the first and second ribbon cables.

6. The system of claim 1, wherein the connector base includes a first end having a guide slot sized to receive a cable tie.

7. The system of claim 1, wherein the connector base includes a first end having a fastener aperture formed to receive a fastener.

8. A connector for operably connecting a first and a second communications bus, the connector comprising:

a connector base including a top side and first and second substantially identical cap engagement areas located on the top side, each cap engagement area including tracks adapted to receive the first or second communications bus and contacts for each track adapted to electrically engage a portion of said communications bus, each contact in the first cap engagement area being in electrical connection with a corresponding contact in the second cap engagement area to form electrically connected pairs of contact, the base including first and second blockoffs proximal to respective first and second cap engagement areas; and a first bus connector cap including tracks sized to receive and retain the first or second communications bus and including a pair of posts sized to interferingly engage the blockoffs if the cap is assembled to the base in a particular orientation.

9. A connector for operably connecting a first and a second communications bus, the connector comprising:

a connector base including first and second substantially identical cap engagement areas, each cap engagement area including tracks adapted to receive the first or second communications bus and contacts for each track adapted to electrically engage a portion of said communications bus, each contact in the first cap engagement area being in electrical connection with a corresponding contact in the second cap engagement area to form electrically connected pairs of contact, the base including first and second blockoffs proximal to respective first and second cap engagement areas;

a first bus connector cap including tracks sized to receive and retain the first or second communications bus and including a pair of posts sized to interferingly engage the blockoffs if the cap is assembled to the base in a particular orientation; and wherein the first bus connector cap includes a second pair of posts sized not to interfere with the blockoff s when the cap is assembled to the base.

10. The connector of claim 9, wherein the first pair of posts is located on a first side of the connector cap and the second pair of posts is located on a non-adjacent side of the connector cap.

11. The connector of claim 10 including a second bus connector cap substantially identical to the first bus connector cap wherein the first connector cap operatively engages the first cap engagement area and the second connector cap operatively engages the second cap engagement area.

12. The connector of claim 11, wherein the first and second communications bus are flat ribbon cables.

13. The connector of claim 12, wherein the bus connector cap includes an outer surface having an alignment guide and wherein the connector base includes first and second base alignment guides on an external surface of the base respectively associated with the first and second cap engagement areas; and wherein the flat ribbon cable, the cap alignment guide and the first and second base alignment guides include a visual indicia to aide in assembly and aligning a portion of the flat ribbon cable, a cap alignment guide, and either a first or second base alignment guide.

14. A connector for operably connecting a first and a second communications bus, the connector comprising:

a connector base including first and second substantially identical cap engagement areas, each cap engagement area including tracks adapted to receive the first or second communications bus and contacts for each track adapted to electrically engage a portion of said communications bus, each contact in the first cap engagement area being in electrical connection with a corresponding contact in the second cap engagement area to form electrically connected pairs of contact, the base including first and second blockoffs proximal to respective first and second cap engagement areas;

a first bus connector cap including tracks sized to receive and retain the first or second communications bus and including a pair of posts sized to interferingly engage the blockoffs if the cap is assembled to the base in a particular orientation; and further including a slot in the base formed and operating sized to receive a fastener.

15. A connector for operably connecting a first and a second communications bus, the connector comprising:

a connector base including first and second substantially identical cap engagement areas, each cap engagement area including tracks adapted to receive the first or second communications bus and contacts for each track adapted to electrically engage a portion of said communications bus, each contact in the first cap engagement area being in electrical connection with a corresponding contact in the second cap engagement area to form electrically connected pairs of contact, the base including first and second blockoffs proximal to respective first and second cap engagement areas;

a first bus connector cap including tracks sized to receive and retain the first or second communications bus and including a pair of posts sized to interferingly engage the blockoffs if the cap is assembled to the base in a particular orientation; and wherein the connector caps and the connector base each include means for assembling the first connector cap to the connector base in a single orientation;

wherein the first and second cap engagement areas include first and second sized lines and the assembling means includes first and second retaining arms on the first connector cap wherein the first retaining arms are sized to receive first and second sized lines and the second retaining arms are sized to receive the first lines but not the second lines.

16. The connector of claim 15 further including means, operably formed in the base, for affixing the connector to a fixture.

17. The connector of claim 16, wherein the affixing means includes a slot penetrating the base and shaped to receive a cable tie.

18. An electrical connector for connecting first and second communications buses, each bus including at least first and second conduits, comprising:

a non-conductive housing including a top side, a first receptacle portion and first contacts for receiving a first bus, and a second receptacle portion and second contacts for receiving a second bus, the first and second receptacle portions being located on the top side, the housing further including connections operably and electrically interconnecting the first contacts with the second contacts;

first cover portion adapted for and operably engaging the first receptacle portion to form a first electrical connection between the first contacts and the first bus such that the first electrical connection is insulated from external electrical contacts;

second cover portion adapted for and operably engaging second receptacle portion to form a second electrical connection between the second contacts and the second bus such that the second electrical connection is insulated from external electrical contacts; and the housing further including at least one aperture sized to receive a fastener.

19. The electrical connection of claim 18, wherein the housing includes a second aperture at an opposing end of the housing from the at least one aperture.

20. The electrical connector of claim 19, wherein the first cover portion includes means for assembling the first cover portion to the housing in a single orientation.

21. The electrical connector of claim 20, wherein the assembling means includes a first pair alignment posts on the first cover portion and spaced a first distance apart and a second pair of posts on the first cover portion spaced a second distance apart.

22. A bus connector comprising:

a first cap having a first side and a second side not adjacent to the first side, a first pair of alignment arms proximal the first side projecting therefrom wherein the first pair of arms are spaced a first distance apart, a second pair of arms proximal the second side and projecting therefrom in a direction corresponding to the direction that the first pair of arms project wherein the second pair of arms are spaced apart a second distance differing from the first distance;

a base adapted to receive at least the first cap in operable engagement wherein the base includes a first cap reception area having a first portion adapted to receive the first pair of arms but not to receive the second pair of arms and having a second portion adapted to receive the second pair of arms.

23. The bus connector of claim 22, further including a second cap having a first side and a second side not adjacent to the first side, a first pair of alignment arms proximal the first side projecting therefrom wherein the first pair of arms are spaced a first distance apart, a second pair of arms proximal the second side and projecting therefrom in a direction corresponding to the direction that the first pair of arms project wherein the second pair of arms are spaced apart a second distance differing from the first distance;

and wherein the base includes a second cap reception area having third portion adapted to receive the first pair of arms from either the first or second cap but not to receive the second pair of arms from the first or second cap;

and having a fourth portion adapted to receive the second pair of arms of the first or second cap.

24. The bus connector of claim 23 the connector base having a longitudinal orientation extending between a first end and a second end, the first end having a guide completely penetrated by a first slot sized to receive a fastener such as a cable tie.

25. The bus connector of claim 24, wherein the second end includes a second guide penetrated by a second slot adapted to receive a fastener such as a cable tie.

* * * * *